US011410686B2

(12) United States Patent
Panda

(10) Patent No.: US 11,410,686 B2
(45) Date of Patent: Aug. 9, 2022

(54) METHODS AND SYSTEMS FOR VOICE AND ACUPRESSURE-BASED LIFESTYLE MANAGEMENT WITH SMART DEVICES

(71) Applicant: VOECE, INC., Pleasanton, CA (US)

(72) Inventor: Rashmi Panda, Dublin, CA (US)

(73) Assignee: VOECE, INC., Pleasanton, CA (US)

( * ) Notice: Subject to any disclaimer, the term of this patent is extended or adjusted under 35 U.S.C. 154(b) by 117 days.

(21) Appl. No.: 16/460,356

(22) Filed: Jul. 2, 2019

(65) Prior Publication Data

US 2020/0160883 A1 May 21, 2020

Related U.S. Application Data

(60) Provisional application No. 62/693,876, filed on Jul. 3, 2018.

(51) Int. Cl.

| | |
|---|---|
| ***G10L 25/90*** | (2013.01) |
| ***G10L 25/66*** | (2013.01) |
| ***G08B 6/00*** | (2006.01) |
| ***G08B 3/10*** | (2006.01) |
| ***A61H 39/04*** | (2006.01) |
| ***G10L 25/63*** | (2013.01) |

(52) U.S. Cl.

CPC ..... *G10L 25/90* (2013.01); *A61H 39/04* (2013.01); *G08B 3/1008* (2013.01); *G08B 6/00* (2013.01); *G10L 25/63* (2013.01); *G10L 25/66* (2013.01); *A61H 2201/0153* (2013.01); *A61H 2201/0157* (2013.01); *A61H 2201/1635* (2013.01)

(58) Field of Classification Search

CPC ..... G10L 25/63; G10L 25/66; G10L 25/90; G08B 3/1008; G08B 6/00; A61H 39/04; A61H 2201/0153; A61H 2201/0157; A61H 2201/1635

USPC ..... 704/200

See application file for complete search history.

(56) References Cited

U.S. PATENT DOCUMENTS

| | | | | |
|---|---|---|---|---|
| 6,353,810 | B1 * | 3/2002 | Petrushin | G10L 17/26 704/236 |
| 6,582,449 | B2 * | 6/2003 | Grey | A61H 39/04 601/107 |
| 9,953,650 | B1 * | 4/2018 | Falevsky | G06F 3/011 |
| 2012/0116186 | A1 * | 5/2012 | Shrivastav | A61B 5/4803 600/301 |
| 2015/0081299 | A1 * | 3/2015 | Jasinschi | G10L 25/66 704/246 |
| 2016/0379225 | A1 * | 12/2016 | Rider | G06K 9/00248 382/116 |

(Continued)

*Primary Examiner* — Pierre Louis Desir
*Assistant Examiner* — Nicole A K Schmieder
(74) *Attorney, Agent, or Firm* — Haverstock & Owens, A Law Corporation

(57) ABSTRACT

In one aspect, a computerized method for implementing voice and acupressure-based lifestyle management includes the step of measuring a speed at which a user is speaking. A wearable device records the user's voice with a microphone and communicates a digital recording of the user's voice to a computer processor. The method includes the step of measuring a time spacing between a set of user's words and a length of the set of user's words. The method includes the step of determining at least one anomaly by comparing the digital recording of the user's voice with a benchmark recording of the user's voice. The method includes the step of alerting the user of the detected anomaly.

20 Claims, 5 Drawing Sheets

(56) References Cited

U.S. PATENT DOCUMENTS

| | | | | |
|---|---|---|---|---|
| 2017/0084295 | A1* | 3/2017 | Tsiartas | G10L 17/02 |
| 2018/0032126 | A1* | 2/2018 | Liu | G06K 9/00302 |
| 2018/0116906 | A1* | 5/2018 | Hirashiki | A61N 1/0484 |
| 2019/0001129 | A1* | 1/2019 | Rosenbluth | A61N 1/0476 |
| 2019/0371344 | A1* | 12/2019 | Noh | G10L 17/26 |

* cited by examiner

METHODS AND SYSTEMS FOR VOICE AND ACUPRESSURE-BASED LIFESTYLE MANAGEMENT WITH SMART DEVICES

CROSS-REFERENCE TO RELATED APPLICATIONS

This application claims priority to U.S. provisional patent application No. 62/693,876, titled METHODS AND SYSTEMS FOR VOICE-BASED LIFESTYLE MANAGEMENT and filed on 3 Jul. 2018. This application is hereby incorporated by reference in its entirety.

BACKGROUND

1. Field

This application relates generally to mobile device, and more particularly to a system, method and article of a voice and acupressure-based lifestyle management with smart devices.

2. Related Art

Users may have emotional states that vary throughout the day. As users respond to various stresses, the users' emotional states can improve or degrade. Users may not be aware of how their exterior demeanor changes and negatively affects others during negative emotional states.

Users often wear smart devices and carry mobile devices such as smart phones. These devices include speaker and computing systems for analyzing user state. Additionally, these devices include means for alerting the users of negative voice attributes, snoring, etc. Accordingly, improvements to the systems for voice and acupressure-based lifestyle management with smart devices are desired.

SUMMARY OF INVENTION

In one aspect, a computerized method for implementing voice and acupressure-based lifestyle management includes the step of measuring a speed at which a user is speaking. A wearable device records the user's voice with a microphone and communicates a digital recording of the user's voice to a computer processor. The method includes the step of measuring a time spacing between a set of user's words and a length of the set of user's words. The method includes the step of determining at least one anomaly by comparing the digital recording of the user's voice with a benchmark recording of the user's voice. The method includes the step of alerting the user of the detected anomaly.

Figure 1:
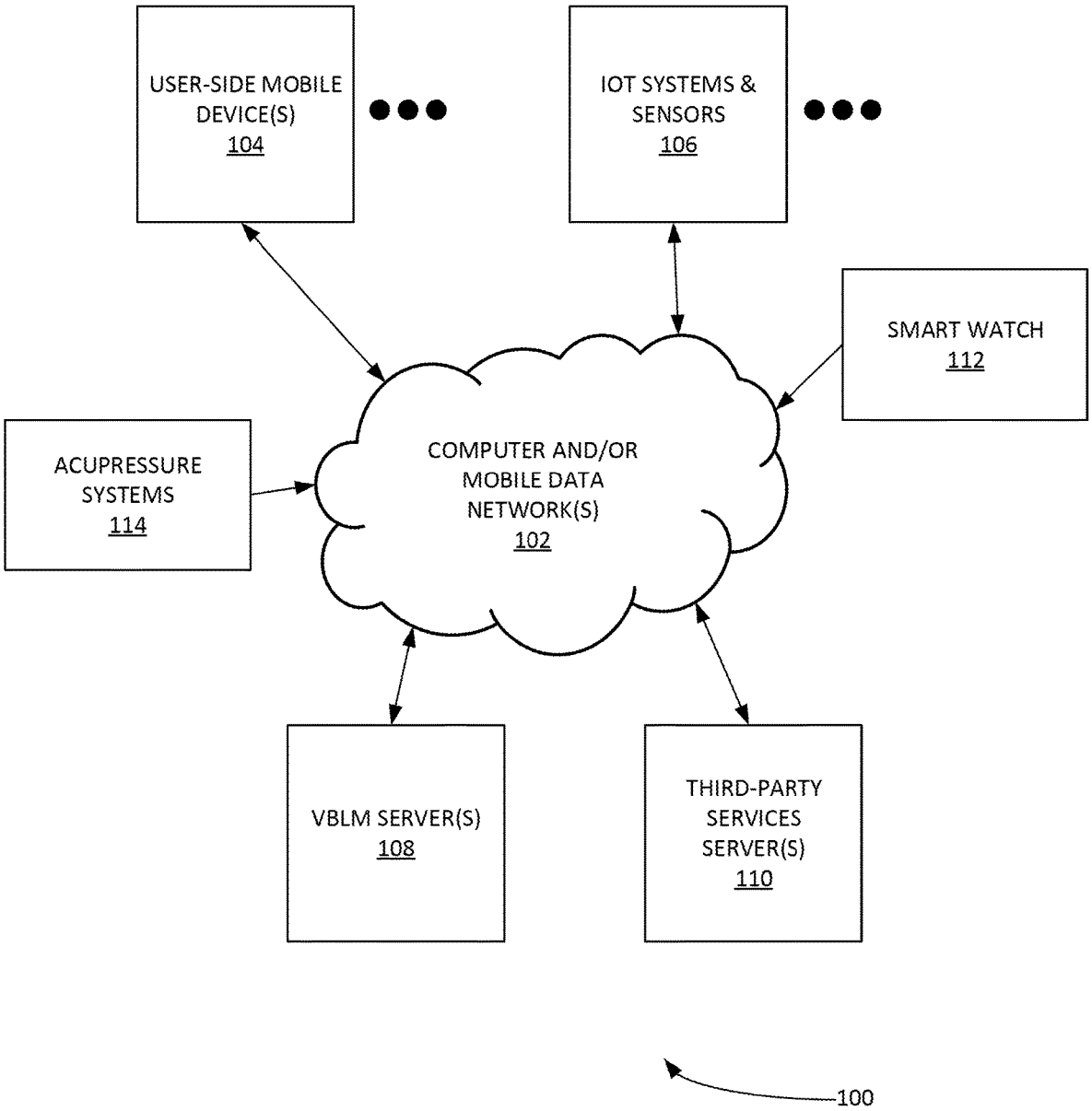
FIG. 1 illustrates an example system used for voice-based lifestyle management, according to some embodiments.

The Figures described above are a representative set and are not an exhaustive with respect to embodying the invention.

DESCRIPTION

Disclosed are a system, method, and article of manufacture for voice and acupressure-based lifestyle management. The following description is presented to enable a person of ordinary skill in the art to make and use the various embodiments. Descriptions of specific devices, techniques, and applications are provided only as examples. Various modifications to the examples described herein can be readily apparent to those of ordinary skill in the art, and the general principles defined herein may be applied to other examples and applications without departing from the spirit and scope of the various embodiments.

Reference throughout this specification to 'one embodiment,' 'an embodiment,' 'one example,' or similar language means that a particular feature, structure, or characteristic described in connection with the embodiment is included in at least one embodiment of the present invention. Thus, appearances of the phrases 'in one embodiment,' 'in an embodiment,' and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, include mechanical parts, hydraulic and air-pressure systems etc., to provide a thorough understanding of embodiments of the invention. One skilled in the relevant art can recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, and they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Definitions

Example definitions for some embodiments are now provided.

Application programming interface (API) can specify how software components of various systems interact with each other.

Cloud computing can involve deploying groups of remote servers and/or software networks that allow centralized data storage and online access to computer services or resources. These groups of remote serves and/or software networks can be a collection of remote computing services.

Internet of Things (IoT) is the network of physical devices, vehicles, home appliances and other items embedded with electronics, software, sensors, actuators, and connectivity which enables these objects to connect and exchange data. Each element can be uniquely identifiable through its embedded computing system but is able to inter-operate within the existing Internet infrastructure.

Mobile device can include a handheld computing device that includes an operating system (OS), and can run various types of application software, known as apps. Example handheld devices can also be equipped with various context sensors (e.g. bio-sensors and physical environment sensors like oxygen meter, radiation meter, allergen meter, temperature meter, pollution meter, humidity meter, co/toxins meter, overall air quality meter, etc.), digital cameras, Wi-Fi, Bluetooth, and/or GPS capabilities. Mobile devices can allow connections to the Internet and/or other Bluetooth-capable devices, such as an automobile, a wearable computing system and/or a microphone headset. Exemplary mobile devices can include smart phones, tablet computers, optical head-mounted display (OHMD), virtual reality head-mounted display, smart watches, other wearable computing systems, etc. It is noted the wearable computing systems can include wired and/or wireless communication systems.

Natural language processing, a branch of artificial intelligence concerned with automated interpretation and generation of human language. NLP functionalities and methods that can be used herein can include, inter alia: statistical natural-language processing (SNLP), Lemmatization, morphological segmentation, part-of-speech tagging, stochastic grammar parsing, sentence breaking, word segmentation, terminology extraction, machine translation, named entity recognition, natural language understanding, lexical semantics, relationship extraction, sentiment analysis, word sense disambiguation, automatic summarization, coreference resolution, discourse analysis, speech segmentation, text-to-speech, OCR, speech to text, etc.

Smart speaker can be a type of wireless speaker and voice command device with an integrated software agent (e.g. that implements various artificial intelligence (AI) based functionalities) that offers interactive actions and handsfree activation. Smart speakers can act as a smart device that utilizes Wi-Fi, Bluetooth and other wireless protocol standards to extend usage beyond audio playback, such as to control home automation devices.

Software agent is a computer program that acts for a user or other program in a relationship of agency. Software agents can interact with people (e.g. as chatbots, human-robot interaction environments, etc.) via human-like qualities such as, inter alia: natural language understanding and speech, personality, and the like.

Speaker recognition is the identification of a person from characteristics of voices (e.g. voice biometrics). Speaker recognition can include voice recognition. ML and AI as can be included with various speaker recognition system.

Example Computer Architecture and Systems

FIG. 1 illustrates an example system 100 used for voice-based lifestyle management, according to some embodiments. System 100 can include various computer and/or cellular data networks 102. Computer and/or cellular data networks 102 can include the Internet, cellular data networks, local area networks, enterprise networks, etc. Networks 102 can be used to communicate messages and/or other information from the various entities of system 100.

System 102 can include voice-based lifestyle management (VBLM) server(s) 108. VBLM server(s) 108 can communicate with user-side computing system(s) 104 and 106. User-side computing system(s) 104 and 106 can include microphones that obtain user voice-data. user-side computing system(s) 104 and 106 can include mobile devices, IoT devices, smart speakers, etc. User-side computing system(s) 104 and 106 also include smart wearable devices that obtain a user's biometric data, location, etc.

In one example, a smart wearable device can include the ability to provide benefits based on acupressure principles while being used in the wrist. For example, the acupressure points can be accessed and through a smart watch and/or a band of said watch. The acupressure benefits that can be associated with the use of smart watch wearable are releasing stress, reducing anxiety, curing insomnia, reducing snoring, help in motion sickness, nausea, vomiting, etc.

Smart watch 112 can be a wearable computer in the form of a wristwatch; modern smartwatches provide a local touchscreen interface for daily use, while an associated smartphone app provides for management and telemetry (e.g. long-term biomonitoring).

Acupressure band 114 can be coupled and/or communicatively coupled with a smart watch/wearable device. Acupressure band 114 can be triggered by specified events. The acupressure system also has the ability to integrate Artificial Intelligence and ML methods. Acupressure band 114 can have a hydraulic and/or air-pressure system for acupressure enablement. Acupressure band 114 includes mechanical parts and connects to the watch through electronics and/or mechanical components. Acupressure band 114 includes wireless network and computer processing systems.

VBLM server(s) 108 can manage a user voice monitoring and analysis system. VBLM server(s) 108 can obtain user voice data from user-side computing system(s) 104 and 106. VBLM server(s) 108 can parse incoming voice data to isolate specific user voice data. VBLM server(s) 108 can implement voice-recognition operations. VBLM server(s) 108 can analyze user voice data based on various variables such as, inter alia: mood, loudness/softness, speed, emotive content, key word content, speech content, pitch, resonance, etc.

VBLM server(s) 108 can manage and monitor the state of various user-side computing system(s) 104 and 106. VBLM server(s) 108 track which user-side computing system(s) 104 and 106 currently provide the highest quality voice data. VBLM server(s) 108 can also use information from user-side computing system(s) 104 and 106 to determine a user context. User context can include a user's current activity, location, demographic data, health state, biofeedback data, biometric data, etc. For example, VBLM server(s) 108 can maintain a biometric profile of the user. This biometric data can be used to determine a meaning/context of voice data. For example, a user's voice can be louder than a baseline while the user's pulse can be normal with a low level of galvanic skin response. Therefore, VBLM server(s) 108 can determine that the user is not in a stressed state even though the voice data indicates a current potential for a stressed state.

VBLM server(s) 108 can include various voice analytics functionalities. For example, VBLM server(s) 108 can convert voice data to a set of quantifiable variables for analysis and storage in a data store. In some example, VBLM server(s) 108 can include machine learning systems. VBLM server(s) 108 can utilize machine learning techniques (e.g. artificial neural networks, etc.). Machine learning is a type of artificial intelligence (AI) that provides computers with the ability to learn without being explicitly programmed. Machine learning focuses on the development of computer programs that can teach themselves to grow and change when exposed to new data. Example machine learning techniques that can be used herein include, inter alia: decision tree learning, association rule learning, artificial neural networks, inductive logic programming, support vector machines, clustering, Bayesian networks, reinforcement learning, representation learning, similarity and metric learning, and/or sparse dictionary learning. VBLM server(s) 108 can include speaker recognition functionalities and speech recognition functionalities. VBLM server(s) 108 can include natural language processing functionalities.

VBLM server(s) 108 can provide dashboard interfaces to users. VBLM server(s) 108 can include web servers, geolocation systems, email servers, IM servers, database management systems, search engines, electronic payment servers, member management systems, administration systems, machine-learning systems, ranking systems, optimizations systems, text messaging systems, etc. Third-party services server (s) 110 can provided various third-party services (e.g. mapping services, geolocation services, online social networking services, machine-learning services, search engine services, etc.).

VBLM server(s) 108 can manage and provide various customer applications (discussed infra). Customer applications can be downloaded to user mobile device, intelligent assistants (e.g. in smart speaker systems), wearable devices, local IoT devices, etc.

VBLM server(s) 108 can learn the uniqueness of a user's voice (e.g. using machine-learning algorithms) it becomes the signature for many custom applications such as, inter alia: voice-based messages from wearables, voice-to-text conversion messages from a mobile device, voice-based payment applications, voice-based security applications, etc.

VBLM server(s) 108 can filter the wearable device user's voice from other voices in a conversation of multiple people or user's voice from other random voices in a surrounding location. VBLM server(s) 108 can measure a user's relaxation state and correlate it with a pulse value from a wearable device. It can be determined if the pulse is too high for the present-type of conversations. It can be determined if the pulse being too high/low pulse is having an impact on the user's voice volume, pitch, tone and resonance. VBLM server(s) 108 can provide alerts to the user when pulse is too high or too low. VBLM server(s) 108 can provide alerts when a user is not relaxed. VBLM server(s) 108 can provide the ability of the wearable device to measure the overall health of the user's voice based on certain benchmark or parameters. VBLM server(s) 108 can provide feedback that also provides insights on what can a user do to improve overall voice health. VBLM server(s) 108 can measure the pulse of user and corelate it to voice quality and patterns from a wearable device. VBLM server(s) 108 can measure the number of steps user takes in a day from wearable device. [VBLM VBLM server(s) 108 can measure a duration and quality of sleep from wearable device. VBLM server(s) 108 can measure the rhythm of the user's voice from a wearable device. The rhythm can be a measure of the smoothness of the user's voice. The rhythm helps to provide feedback to people regarding quality of their speech. Feedback on rhythm can help speakers improve their speech quality. VBLM server(s) 108 can enable a user to make voice calls through wearable by connecting wearable to a wireless Internet network. Applications in user-side computing system(s) 104 and 106 can include these managed functionalities.

Other applications can be provided and managed by VBLM server(s) 108. The following is a list of example applications related to voice-based lifestyle management. VBLM server(s) 108 can provide and manage a Voice based Pay application. For example, a wearable application can be used to make payments from bank accounts and credit cards based on the user's voice signature.

VBLM server(s) 108 can provide and manage voice-based texting application. For example, the user can use voice to text conversion s/w and send text messages using the user's phone from the user's wearable device.

VBLM server(s) 108 can provide and manage a voice-based email application. For example, the user can use voice-to-text conversion s/w and send emails using the user's phone from the user's wearable device or the user can attach the voice recording as email attachment and communicate it.

VBLM server(s) 108 can provide and manage voice messages from a wearable device. For example, the user can send voice-based messages directly to other users using the user's phone from a wearable device.

VBLM server(s) 108 can provide and manage voice-based security services. For example, the user can design custom security applications based on the user's voice signature and this can be controlled from a wearable device.

VBLM server(s) 108 can provide and manage custom surroundings based on the size of room.

VBLM server(s) 108 can provide and manage an application to provide user feedback on voice characteristics (e.g. volume, pitch, tone, resonance, etc.) based on the size of room. The application can help the user adjust voice characteristics based on surrounding contexts.

VBLM server(s) 108 implement a voice to voice message functionality. This can be activated by user tap and/or voice command from user. It confirms if BLUETOOTH is connected or not and shows via a GUI element that the voice message functionality is enabled. It has the capability of starting the recording on the watch and then sending a message to users contact through the phone. The functionality enables a handsfree voice message sent from a watch either enabled through tap or through voice assistant.

VBLM server(s) 108 use advanced algorithms and/or machine learning and/or artificial intelligence (AI) to measure snoring. The wearable device records snoring time and snoring frequency of the user. The wearable device displays snoring metric when the smart watch detects the user is sleeping and while sleep tracking. The wearable device records and displays a snore meter capability in the smart watch interface and/or other mobile device applications.

VBLM server(s) 108 can provide and manage the customization of microphone inputs and effects based surrounding contexts (e.g. microphone and/or sound system effects and/or dampeners, etc.).

VBLM server(s) 108 can provide and manage an application to provide user feedback on voice characteristics (e.g. volume, pitch, tone, resonance, etc.) based on presence of physical elements that can have an impact on voice such as microphone system state, sound-system state, dampener state, etc. This can also assist a user to adjust voice characteristics based on surrounding context.

VBLM server(s) 108 can measure the melody of the user's voice from a wearable device. For example, applications of rhythm measurement and analysis can be extended to provide feedback regarding the melody of voice to singers. Melody settings and voice control feedback can be customized depending on the type of songs/music genre (e.g. jazz genre, Rock and Roll genre, etc.).

VBLM server(s) 108 can provide a snore meter system. This can measure the snoring volume, patterns and correlation with pulse and quality of sleep from wearable device.

VBLM server(s) 108 use advanced algorithms and/or ML and AI to filter user's voice from ambient noise. VBLM server(s) 108 use measure the total volume reaching the smart watch as well. This provides information around user's voice and total volume around the smart watch and/or the user's surrounding environment/context. VBLM server(s) 108 can provide a sound alert and/or haptic signal to 'buzz' the user when the volume exceeds a specified decibel limit for the user. The buzz signal is also generated when the total noise around the watch/surrounding exceeds a certain threshold. The buzz signal is also activated on pulse thresholds of the user learnt by using ML/AI techniques and/or hardcoded values for pulse related buzz for the user.

VBLM server(s) 108 can provide a 'buzz by situation' functionality. This can provide a haptic buzz functionality on the wearable device based on certain voice characteristics (e.g. volume too high or too low, user too excited, pitch and tone too high, etc.).

VBLM server(s) 108 can provide a voice confidence meter functionality. For example, based on voice characteristics, the voice confidence meter functionality can provide a confidence meter measure to the user based on certain benchmarks or user defined criteria.

VBLM server(s) 108 can provide a volume meter. They can provide feedback regarding voice volume to the wearable user based on benchmarks or custom levels.

VBLM server(s) 108 use advanced algorithms and/or leverage AI/ML to measure user's volume and the total volume of the surrounding around the watch.

VBLM server(s) 108 can enable voice-based emergency calling services. For example, the user can have the ability to dial 911 or other custom emergency calls from wearable device using the user's phone. VBLM server(s) 108 can enable, in addition to emergency calling, other emergency service access such as, inter alia: texting, voice messaging from a wearable device. The emergency calling service can be 911 (e.g. as in the United States) or a custom emergency calling selected by the user (e.g. a parent, guardian, educational institution, religious institution, police/security service, etc.).

VBLM server(S) can enable and manage a voice confidence meter. The voice confidence meter can measure confidence in voice and provide feedback about time/context of greatest/least confidence. This can use voice recordings, pulse, language content, etc.

Figure 2:
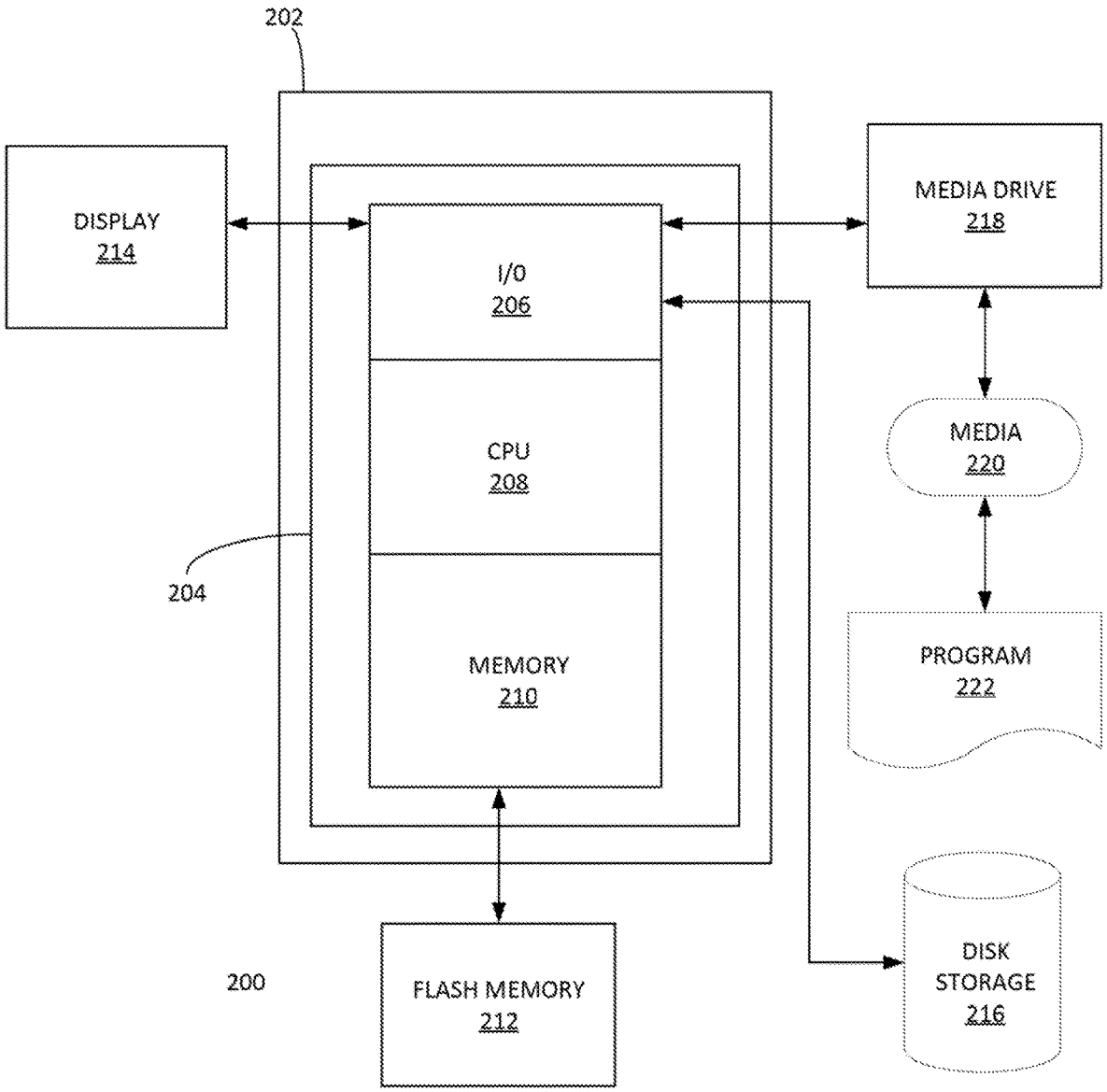
FIG. 2 depicts an exemplary computing system that can be configured to perform any one of the processes provided herein.

FIG. 2 depicts an exemplary computing system 200 that can be configured to perform any one of the processes provided herein. In this context, computing system 200 may include, for example, a processor, memory, storage, and I/O devices (e.g., monitor, keyboard, disk drive, Internet connection, etc.). However, computing system 200 may include circuitry or other specialized hardware for carrying out some or all aspects of the processes. In some operational settings, computing system 200 may be configured as a system that includes one or more units, each of which is configured to carry out some aspects of the processes either in software, hardware, or some combination thereof.

Smart devices also include capabilities of acupressure methods of providing health benefits to users. The acupressure band of the watch/wearable has capabilities that can be triggered by specified events. The acupressure system also has the ability to integrate Artificial Intelligence and ML methods. AI and ML methods help to study every user and accordingly generate acupressure on PC6 and H7 points of the user. The smart watch also has the capability to generate acupressure on PC6 and H7 points with hard coded values in the absence of AI and ML capabilities. The acupressure system can activate once the wearable detects the user is snoring. In the usage of AI/ML techniques, the acupressure system activates prior to a user snoring. The wearable device includes AI/ML technology that enables the system to estimate a user is about to snore and hence generate the acupressure signal proactively. The PC6, H7 acupressure points can be activated. Acupressure band of the watch/wearable has capabilities that can be triggered by specified events. The acupressure system also has the ability to integrate Artificial Intelligence and ML methods. An acupressure band that has a hydraulic and/or air-pressure system for acupressure enablement. The acupressure band includes mechanical parts and connects to the watch through electronics and/or mechanical components.

A self-actuated acupressure can be provided. The acupressure system self-activates when the pulse rate and or user's volume is outside this range of a user. The normal pulse is learnt either by AI/ML or hardcoded values in the application. The acupressure system also activates on user's snoring, pulse and volume defined thresholds. In one example, the acupressure system once activated, doesn't reactive for the next few hours An acupressure override button can be provided. The acupressure override button functionality in the acupressure band can activate the acupressure system for a few minutes once pressed. For user pressing multiple times, it activates only once and ignores the other press signals.

FIG. 2 depicts computing system 200 with a number of components that may be used to perform any of the processes described herein. The main system 202 includes a motherboard 204 having an I/O section 206, one or more central processing units (CPU) 208, and a memory section 210, which may have a flash memory card 212 related to it. The I/O section 206 can be connected to a display 214, a keyboard and/or other user input (not shown), a disk storage unit 216, and a media drive unit 218. The media drive unit 218 can read/write a computer-readable medium 220, which can contain programs 222 and/or data. Computing system 200 can include a web browser. Moreover, it is noted that computing system 200 can be configured to include additional systems in order to fulfill various functionalities. Computing system 200 can communicate with other computing devices based on various computer communication protocols such a Wi-Fi, Bluetooth® (and/or other standards for exchanging data over short distances includes those using short-wavelength radio transmissions), USB, Ethernet, cellular, an ultrasonic local area communication protocol, etc.

Figure 3:
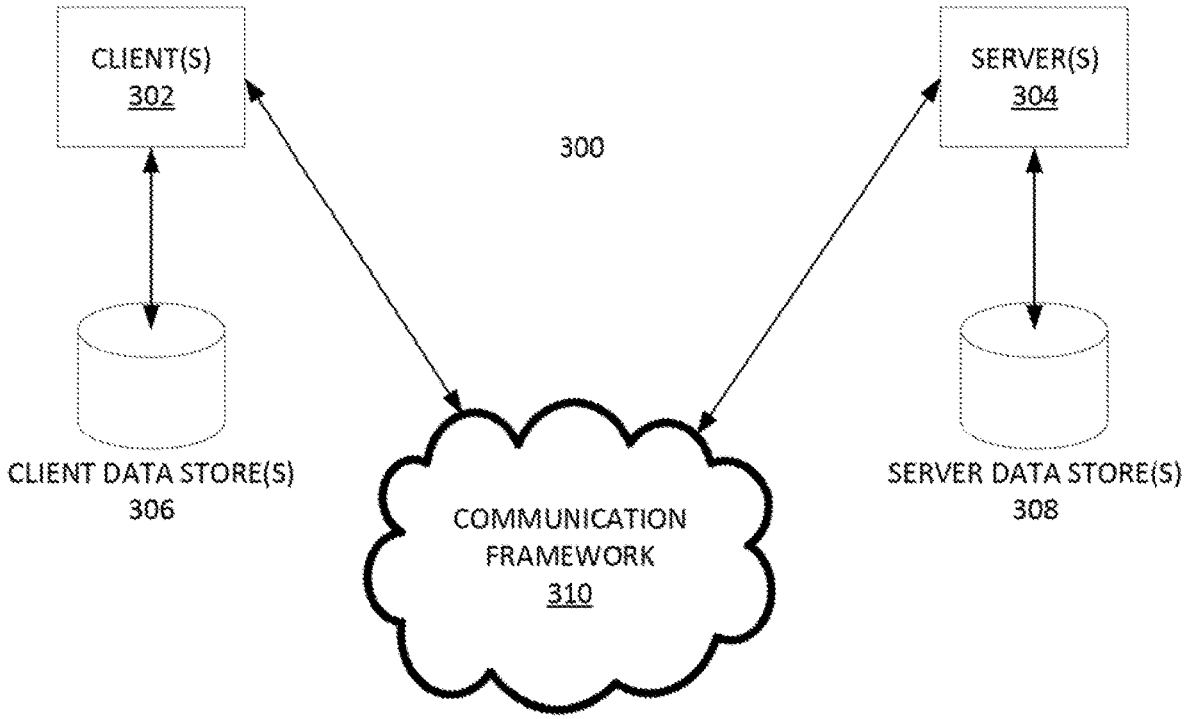
FIG. 3 is a block diagram of a sample computing environment that can be utilized to implement various embodiments.

FIG. 3 is a block diagram of a sample computing environment 300 that can be utilized to implement various embodiments. The system 300 further illustrates a system that includes one or more client(s) 302. The client(s) 302 can be hardware and/or software (e.g., threads, processes, computing devices). The system 300 also includes one or more server(s) 304. The server(s) 304 can also be hardware and/or software (e.g., threads, processes, computing devices). One possible communication between a client 302 and a server 304 may be in the form of a data packet adapted to be transmitted between two or more computer processes. The system 300 includes a communication framework 310 that can be employed to facilitate communications between the client(s) 302 and the server(s) 304. The client(s) 302 are connected to one or more client data store(s) 306 that can be employed to store information local to the client(s) 302. Similarly, the server(s) 304 are connected to one or more server data store(s) 308 that can be employed to store information local to the server(s) 304. In some embodiments, system 300 can instead be a collection of remote computing services constituting a cloud-computing platform.

Customer Application Methods

Various methods of data collection and other functions are now discussed.

Figure 4:
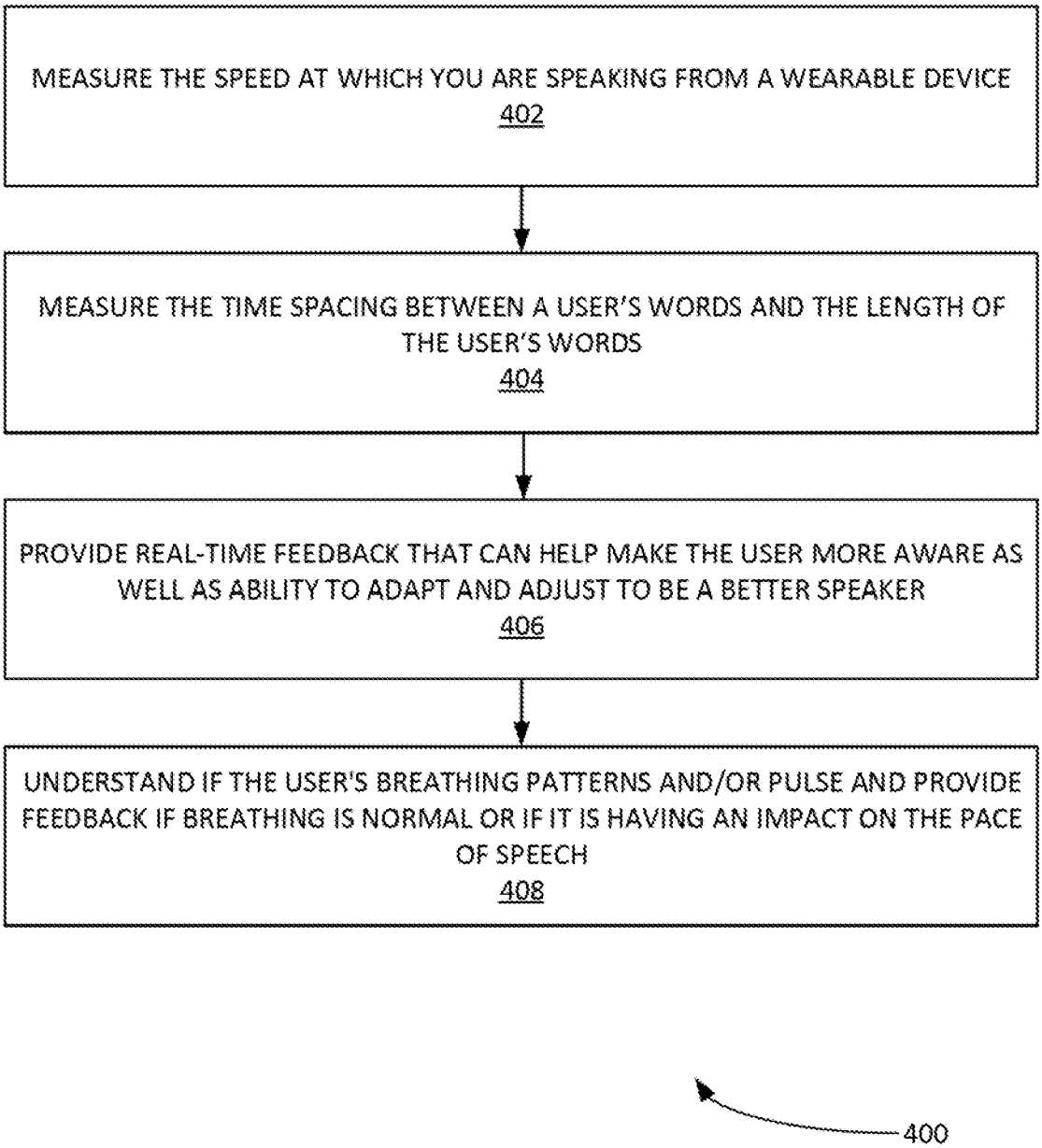
FIG. 4 illustrates an example process for implementing voice-based lifestyle management, according to some embodiments.

FIG. 4 illustrates an example process 400 for implementing voice-based lifestyle management, according to some embodiments. In step 402, process 400 can measure the speed at which the user is speaking from a wearable device. In step 404, process 400 can measure the time spacing between a user's words and the length of the user's words. This data can be used to determine various anomalies that can be highlighted to the customer to improve the speed of their speech. Is the user speaking way too slow compared to the benchmark of speaking? In step 406, process 400 can provide real-time feedback that can help make the user more aware as well as ability to adapt and adjust to be a better speaker. Process 400 can also understand if the user's breathing patterns and/or pulse and provide feedback if breathing is normal or if it is having an impact on the pace of speech in step 408.

Figure 5:
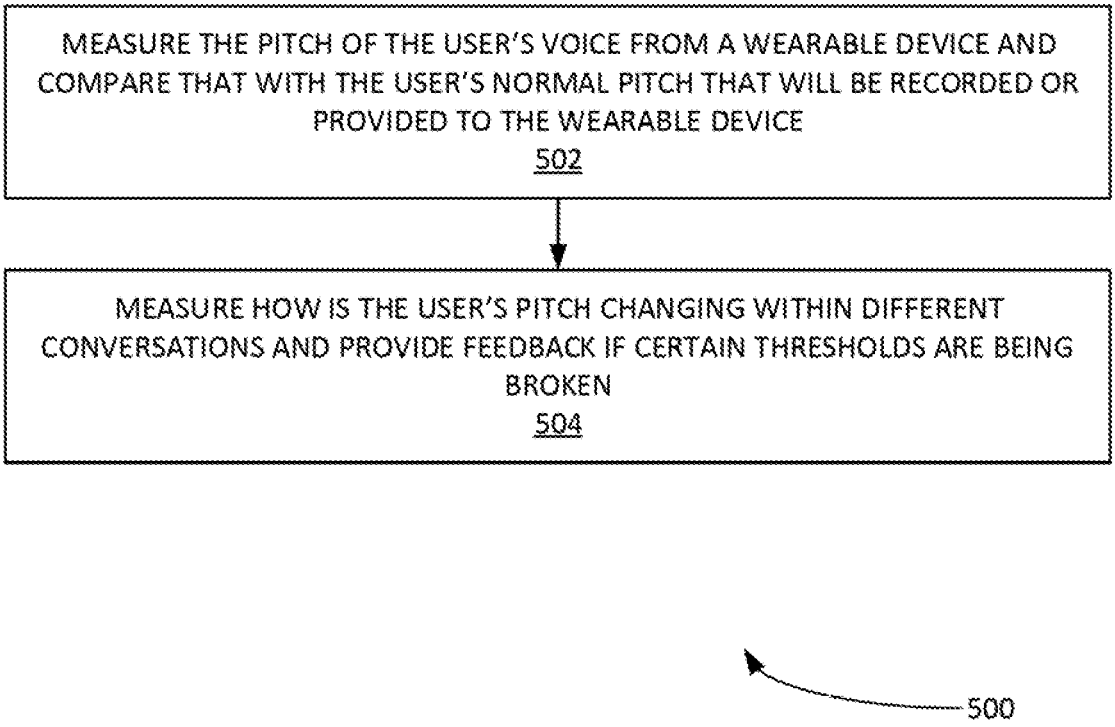
FIG. 5 illustrates an example process for implementing voice-based lifestyle management, according to some embodiments.

FIG. 4 illustrates an example process 400 for implementing voice-based lifestyle management, according to some embodiments. FIG. 5 illustrates an example process 500 for implementing voice-based lifestyle management, according to some embodiments. In step 502, process 500 measure the pitch of the user's voice from a wearable device and compare that with the user's normal pitch that will be recorded or provided to the wearable device. In step 504, process 500 can measure how is the user's pitch changing within different conversations and provide feedback if certain thresholds are being broken.

It is noted that the processes provided here can learn a user's voice using AI/ML. Additionally, a voice enabled AI assistant can be provided to the user.

It is noted that resonance can help measure the quality of the sound from a wearable device. Resonance can also assist in defining if the user's voice is too shallow or too deep and help the user understand and hence adjust based on the nature of voice applications. For example, resonance can help distinguish between speaking in a meeting vs. singing.

Conclusion

Although the present embodiments have been described with reference to specific example embodiments, various modifications and changes can be made to these embodiments without departing from the broader spirit and scope of the various embodiments.

What is claimed as new and desired to be protected by Letters Patent of the United States is:

1. A computerized method for implementing voice and acupressure-based lifestyle management comprising:

receiving, from a wearable device, digital sound data of a user, wherein the wearable device is not acupressure enabled and is coupled with an acupressure band that comprises at least one of a hydraulic or an air-pressure system;

determining, from the digital sound data, voice characteristics of the user, wherein the voice characteristics include:

a speed at which the user is speaking, a time spacing between a set of words, and a length of the set of words;

determining whether the digital sound data includes at least one anomaly by comparing the voice characteristics with benchmark data for the user and, in response to determining the digital sound data includes the at least one anomaly, causing the wearable device to alert the user of the at least one anomaly;

integrating at least one machine learning technique with the at least one of the hydraulic or the air-pressure system, wherein when a determination is made by the at least one machine learning technique that the digital sound data includes at least one first voice variable, the at least one of the hydraulic or the air-pressure system is activated within the acupressure band.

2. The computerized method of claim 1, further comprising: providing real-time feedback that helps the user to adapt and adjust to be a better speaker.

3. The computerized method of claim 1, further comprising: measuring, from the digital sound data, a breathing pattern of the user to determine a breath rate of the user.

4. The computerized method of claim 3, wherein the breath rate is measured with the user's speech.

5. The computerized method of claim 1, further comprising: receiving, from the wearable device, pulse rate data of the user.

6. The computerized method of claim 1, further comprising: determining an emotional state of the user based on a pulse rate, a breath rate, and a speech pattern of the user.

7. The computerized method of claim 6, further comprising: providing feedback to the wearable device when the determined emotional state is a negative or highly emotional state.

8. The computerized method of claim 1, wherein the acupressure band comprises a computer networking system and one or more mechanical acupressure applicators.

9. The computerized method of claim 1, further comprising: causing the acupressure-band to apply pressure to a specified acupressure point based on a detected user emotional state or a specified pulse rate of the user.

10. The computerized method of claim 9, wherein the specified acupressure point comprises a PC6 acupressure point or an H7 acupressure point.

11. The computerized method of claim 1, wherein causing the wearable device to alert comprises activating an alarm sound or generating a haptic signal.

12. The computerized method of claim 1, wherein when a determination is made by the at least one machine learning technique of an onset of a second voice variable, the at least one of the hydraulic or the air-pressure system is proactively activated within the acupressure band prior to occurrence of the second voice variable.

13. The computerized method of claim 1, wherein the at least one machine learning technique is configured to determine where at least one acupressure point is on a wrist of the user, wherein the acupressure is applied to the at least one acupressure point.

14. A computerized system useful for implementing voice and acupressure-based lifestyle management comprising:

at least one processor configured to execute instructions;

at least one memory containing instructions when executed on the at least one processor, causes the at least one processor to perform operations that:

receive, from a wearable device, digital sound data of a user, wherein the wearable device is not acupressure enabled and is coupled with an acupressure band that comprises at least one of a hydraulic or an air-pressure system;

determine, from the digital sound data, voice characteristics of the user, wherein the voice characteristics include:

a speed at which the user is speaking, a time spacing between a set of words, and a length of the set of words;

determine whether the digital sound data includes at least one anomaly by comparing the voice characteristics with benchmark data for the user and, in response to determining the digital sound data includes the at least one anomaly, causing the wearable device to alert the user of the at least one anomaly;

integrating at least one artificial intelligence technique with the at least one of the hydraulic or the air-pressure system, wherein when a determination is made by the at least one artificial intelligence technique that the digital sound data includes at least one first voice variable, the at least one of the hydraulic or the air-pressure system is activated within the acupressure band.

15. The computerized system of claim 14, wherein the acupressure band comprises a computer networking system and one or more mechanical acupressure applicators.

16. The computerized system of claim 14, wherein the instructions, when executed on the at least one processor, causes the at least one processor to further perform operations that causes the acupressure band to apply pressure to a specified acupressure point based on a detected user emotional state or a specified pulse rate of the user.

17. The computerized system of claim 16, wherein the specified acupressure point comprises a PC6 acupressure point or an H7 acupressure point.

18. The computerized system of claim 14, wherein the instructions, when executed on the at least one processor, causes the at least one processor to further perform operations that measures one or more of the user's voice volume, pitch, resonance, signature, or melody.

19. A computerized method for implementing voice and acupressure-based lifestyle management comprising:

receiving, from a wearable device, digital sound data of a user, wherein the wearable device is not acupressure enabled and is coupled with an acupressure band that comprises at least one of a hydraulic or an air-pressure system;

determining, from the digital sound data, voice characteristics of the user, wherein the voice characteristics include:

a speed at which the user is speaking, a time spacing between a set of words, and a length of the set of words;

determining whether the digital sound data includes at least one anomaly by comparing the voice characteristics with benchmark data for the user and, in response to determining the digital sound data includes the at least one anomaly, causing the wearable device to alert the user of the at least one anomaly;

integrating at least one artificial intelligence technique with the at least one of the hydraulic or the air-pressure system, wherein when a determination is made by the at least one artificial intelligence technique that the digital sound data includes at least one first voice variable, the at least one of the hydraulic or the air-pressure system is activated within the acupressure band so as to apply acupressure at one or more acupressure points.

20. The computerized method of claim 19, wherein the at least one artificial intelligence technique is configured to learn the user's voice.

* * * * *